US009793652B2

(12) United States Patent
Bausch et al.

(10) Patent No.: US 9,793,652 B2
(45) Date of Patent: Oct. 17, 2017

(54) CONTACT DEVICE FOR CONTACTING AN ELECTRIC CONDUCTOR AND AN ELECTRICAL CONNECTOR TO AN ELECTRICAL CONDUCTOR TRACK

(71) Applicant: Eaton Electrical IP GmbH & Co. KG, Schoenefeld (DE)

(72) Inventors: Christoph Bausch, Bonn (DE); Guido Dedenbach, Bonn (DE); Karsten Gerving, Bonn (DE); Ralf Thar, St. Augustin (DE); Sergei Eck, Diersdorf (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 15/256,772

(22) Filed: Sep. 6, 2016

(65) Prior Publication Data

US 2017/0070004 A1 Mar. 9, 2017

(30) Foreign Application Priority Data

Sep. 7, 2015 (DE) ..... 10 2015 114 938

(51) Int. Cl.

| | |
|---|---|
| ***H01R 4/24*** | (2006.01) |
| ***H01R 4/48*** | (2006.01) |
| ***H01R 13/633*** | (2006.01) |
| ***H01R 13/631*** | (2006.01) |

(52) U.S. Cl.

CPC ..... *H01R 13/6335* (2013.01); *H01R 13/631* (2013.01)

(58) Field of Classification Search

CPC .. H01R 4/4809; H01R 4/4836; H01R 4/4818; H01R 13/635; H01R 13/633; H01R 13/639; H01R 13/6335

USPC ..... 439/441, 835

See application file for complete search history.

(56) References Cited

U.S. PATENT DOCUMENTS

| | | | | |
|---|---|---|---|---|
| 7,568,939 | B2 * | 8/2009 | Diekmann | H01R 4/4818 439/438 |
| 8,292,677 | B2 * | 10/2012 | Gassauer | H01R 4/4836 439/729 |
| 8,460,038 | B2 * | 6/2013 | Eisert | H01R 9/2625 439/716 |
| 9,466,911 | B1 * | 10/2016 | Wu | H01R 4/4836 |
| 9,525,217 | B2 * | 12/2016 | Kollmann | H01R 4/4836 |
| 2003/0194918 | A1 | 10/2003 | Fricke et al. | |

(Continued)

FOREIGN PATENT DOCUMENTS

| | | |
|---|---|---|
| CN | 203312499 U | 11/2013 |
| DE | 20205821 U1 | 8/2003 |

(Continued)

*Primary Examiner* — Xuong Chung Trans

(74) *Attorney, Agent, or Firm* — Leydig, Voit & Mayer, Ltd.

(57) ABSTRACT

A contacting device has a housing having a first opening for inserting the electrical conductor and the electrical plug into a cavity in the housing, and having a second opening for inserting the electrical conducting track into the cavity in the housing. The contacting device further has a contact bridge which is arranged in the cavity in the housing and comprises a first portion for fixing the electrical conductor to the electrical conducting track in a force fit, and a second portion for retaining the electrical plug on the electrical conducting track and pressing it thereagainst.

10 Claims, 3 Drawing Sheets

(56) References Cited

U.S. PATENT DOCUMENTS

| | | | |
|---|---|---|---|
| 2007/0072481 | A1 | 3/2007 | Edenharter |
| 2009/0061669 | A1 | 3/2009 | Diekmann |
| 2009/0130893 | A1 | 5/2009 | Revollon et al. |
| 2010/0167573 | A1 | 7/2010 | Dhandapani et al. |
| 2014/0127932 | A1 | 5/2014 | Hoppmann et al. |

FOREIGN PATENT DOCUMENTS

| | | | |
|---|---|---|---|
| DE | 102005045596 | B3 | 6/2007 |
| DE | 102008039232 | A1 | 2/2010 |
| DE | 102008055776 | A1 | 5/2010 |
| DE | 202010014008 | U1 | 1/2012 |
| DE | 102011115637 | A1 | 12/2012 |
| EP | 1353407 | A1 | 10/2003 |
| EP | 1867009 | A1 | 12/2007 |

* cited by examiner

CONTACT DEVICE FOR CONTACTING AN ELECTRIC CONDUCTOR AND AN ELECTRICAL CONNECTOR TO AN ELECTRICAL CONDUCTOR TRACK

CROSS-REFERENCE TO RELATED APPLICATIONS

Priority is claimed to German Patent Application No. DE 10 2015 114 938.9, filed on Sep. 7, 2015.

FIELD

The invention relates to a contacting device for contacting an electrical conductor and an electrical plug with an electrical conducting track. The invention also relates to an arrangement for connecting an electrical cable to an electrical conducting track.

BACKGROUND

In a conventional contacting device for contacting an electrical conductor and an electrical conducting track on the basis of the push-in clamping technique, the stripped end of an electrical conductor is pushed into a terminal of the contacting device and can thus be fixed to the contacting device without the need to operate an actuating mechanism or to use a tool therefor. The terminal of the contacting device can comprise a pretensioned leaf spring, for example, which is deflected by the end of the conductor inserted into the contacting device.

The leaf spring can have a sharp-edged end. As soon as the end of the electrical conductor passes over the sharp-edged end of the leaf spring, the edge of the leaf spring presses the conductor against an electrical conducting track inside the housing of the contacting device and secures the electrical conductor against slipping out of the contacting device by notching into the material of the conductor. In order to release the electrical conductor from the terminal, the leaf spring is usually deflected further by an actuating mechanism or a suitable tool, and therefore frees the end of the electrical conductor, so that the electrical conductor can be removed from the contacting device again.

In addition to contacting between an individual electrical conductor and the electrically conductive bearing surface/conducting track inside the contacting device, it is often necessary to couple an electrical plug arranged for example at the end of an electrical cable to the electrically conductive bearing surface/conducting track. Contrary to a single electrical conductor, which has to be secured against slipping out once it has been inserted into the contacting device, the plug is intended to be removable from the contact device again simply by pulling it counter to its insertion direction.

In the abovementioned embodiment of the contacting device, in a similar manner to releasing the electrical conductor, the actuating mechanism would likewise need to be operated or a suitable tool would need to be used to release the plug from the terminal of the contacting device by deflecting the leaf spring further, in order to remove the plug from the contacting device. This procedure of releasing the plug from the contacting device is particularly laborious in particular when the plug comprises a plurality of plug pins which are fixed in a corresponding number of terminals of the contacting device. In this case, in order to release the plug, all actuating mechanisms would need to be operated at the same time or a plurality of tools would have to be used at the same time in order to bend the individual leaf springs away to release the plug pins.

SUMMARY

An aspect of the invention provides a contacting device for contacting an electrical conductor and an electrical plug with an electrical conducting track, the device comprising: a housing including a first opening configured for insertion of the electrical conductor and the electrical plug into a cavity in the housing, and including a second opening configured for insertion of the electrical conducting track into the cavity in the housing; a contact bridge, arranged in the cavity in the housing, including a first portion configured to fix the electrical conductor to the electrical conducting track in a force fit, and a second portion configured to retain the electrical plug on the electrical conducting track and press the electrical plug against the electrical conducting track, the second portion being bent in a different direction from the first portion; and a lever configured to move the contact bridge such that the electrical conductor can be released from the force fit, wherein the second portion of the contact bridge is shaped such that the electrical plug can be removed from the cavity in the housing by pulling on the electrical plug when the electrical plug is pressed on the electrical conducting track by the contact bridge and is retained in the cavity in the housing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
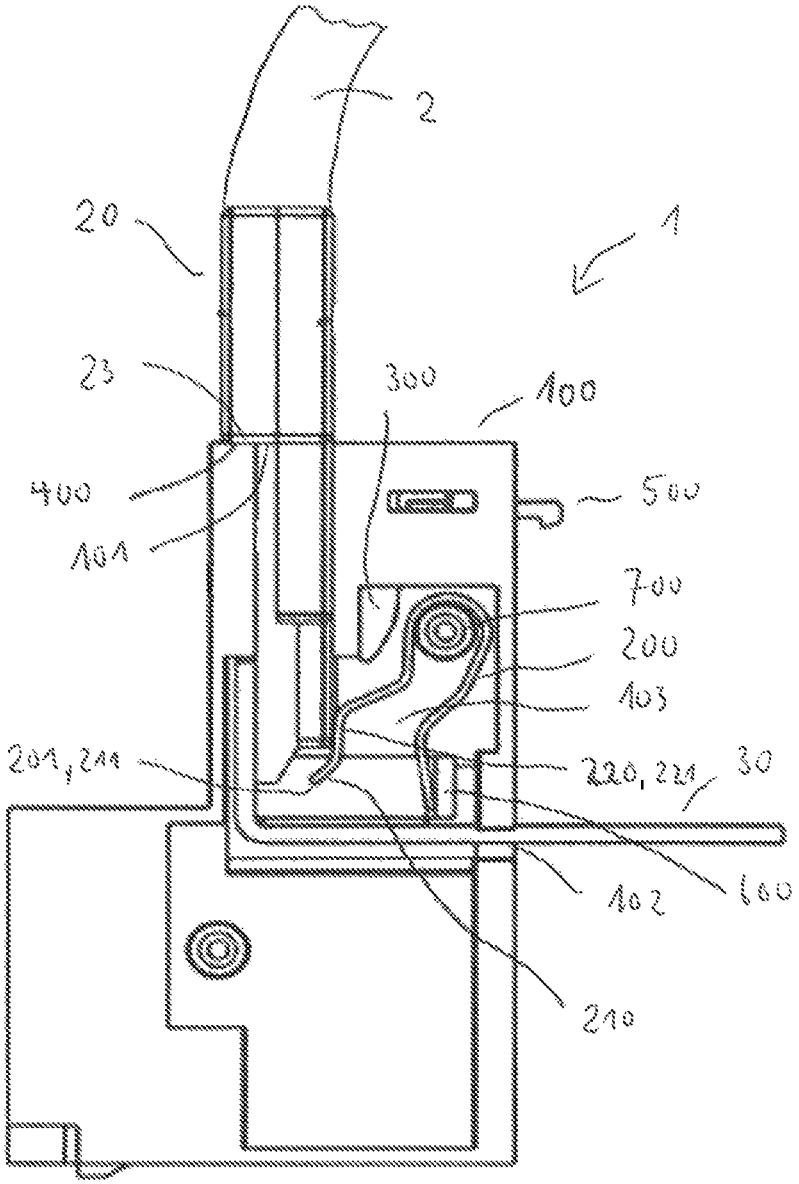
FIG. 1 is a cross section through an embodiment of a contacting device for contacting an electrical conductor and an electrical plug with an electrical conducting track.
Figure 2A:
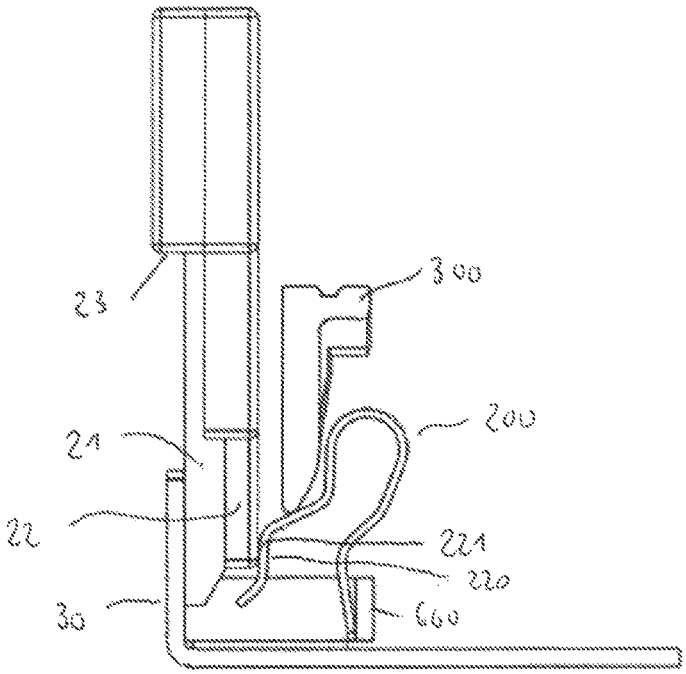
FIG. 2A is a cross section of a contact bridge and a lever for moving the contact bridge of the contacting device, together with an electrical plug which is pressed against an electrical conducting track by the contact bridge.
Figure 2B:
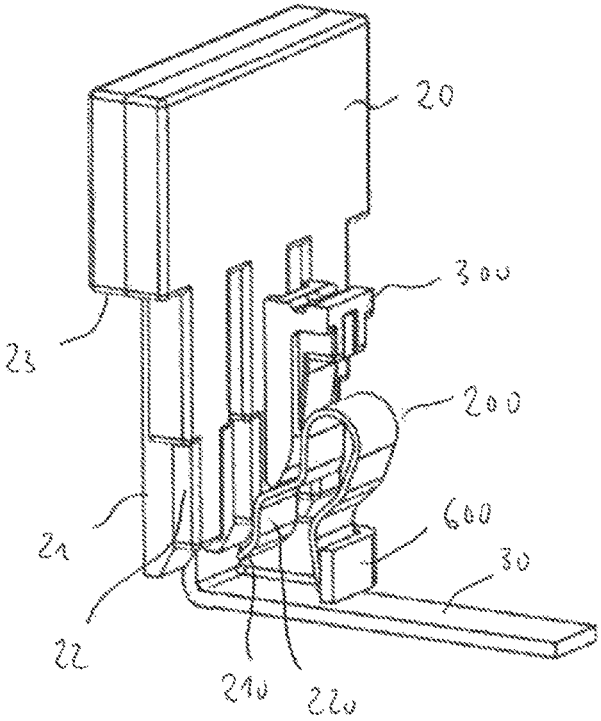
FIG. 2B is a 3D view of a contact bridge and a lever for moving the contact bridge of the contacting device, together with an electrical plug which is pressed against an electrical conducting track by the contact bridge.

In an embodiment, the present invention provides a contacting device for contacting an electrical conductor and an electrical plug with an electrical conducting track, by means of which it is possible to securely contact the electrical conductor and the electrical plug with the electrical conducting track, the electrical conductor being secured against slipping out of the contacting device, and, although the electrical plug is retained securely in the contacting device, it can be removed from the contacting device again simply by pulling it counter to the insertion direction thereof. Another embodiment of the present invention provides an arrangement for connecting an electrical cable to an electrical conducting track, it being possible for the electrical cable to be securely connected to the electrical conducting track on the one hand, and for the connection to be easily released again on the other.

One embodiment of a contacting device having a corresponding design for contacting an electrical conductor and an electrical plug with an electrical conducting track is a contacting device for contacting an electrical conductor and an electrical plug with an electrical conducting track, comprising: a housing (100) having a first opening (101) for inserting the electrical conductor (10) and the electrical plug (20) into a cavity (103) in the housing (100), and having a second opening (102) for inserting the electrical conducting track (30) into the cavity (103) in the housing; a contact bridge (200) which is arranged in the cavity (103) in the housing and comprises a first portion (210) for fixing the electrical conductor (10) to the electrical conducting track (30) in a force fit, and comprises a second portion (220) for retaining the electrical plug (20) on the electrical conducting track (30) and pressing it thereagainst, wherein the second portion (220) is bent in a different direction from the first portion (210); a lever (300) for moving the contact bridge (200) such that the electrical conductor (10) can be released from the force fit, wherein the second portion (220) of the contact bridge (200) is shaped such that the electrical plug (20) can be removed from the cavity (103) in the housing by pulling on the electrical plug (20) when it is pressed on the electrical conducting track (30) by the contact bridge (200) and is retained in the cavity (103) in the housing.

The contact bridge of the contacting device is designed as a clamping spring and has such a geometry that the electrical conductor abuts a first portion of the contact bridge, in particular a sharp-edged end of the first portion of the contact bridge, and is secured against slipping out of the contacting device by the sharp-edged end of the contact bridge notching into the material of the electrical conductor. In contrast, the electrical plug inserted into the contacting device abuts a second portion of the contact bridge which is bent in a different way from the first portion. The second portion of the contact bridge comprises a specially shaped portion that does not have any edges.

According to a possible embodiment, the contacting device comprises a stop element and the plug comprises a stop element that has a correspondingly complementary shape thereto. When inserted into the contacting device, the stop element of the plug bears against the stop element of the contacting device so that the plug cannot be inserted into the contacting device to such an extent that it touches the sharp-edged end of the contact bridge. The electrical plug is retained by the static friction generated by the pressing force of the deflected second portion of the contact bridge, but can be removed from the contacting device again by overcoming this frictional force without the contact bridge having to be deflected further by an actuating mechanism of the contacting device having a corresponding design or by a special tool for this purpose.

One embodiment of an arrangement for connecting an electrical cable to an electrical conducting track is provided by an arrangement for connecting an electrical cable to an electrical conducting track, comprising: a contacting device (1) according to an aspect of the invention; an electrical plug (20) arranged at one end of the electrical cable (2) for contacting the electrical cable, wherein the electrical plug (20) comprises an electrical contact (21) and a non-conductive bearing element (22), on which the electrical contact (21) is arranged, the bearing region (221) of the second portion (220) of the contact bridge (200) is pressed against the non-conductive bearing element (22) of the electrical plug (20) when the electrical plug (20) is inserted into the first opening (101) in the housing (100) of the contacting device, the electrical contact (21) of the electrical plug (20) is pressed against the electrical conducting track (30) by the pressing force of the second portion (220) of the contact bridge (200) when the electrical conducting track (30) is inserted into the second opening (102) in the housing (100) of the contacting device (1).

Figure 3:
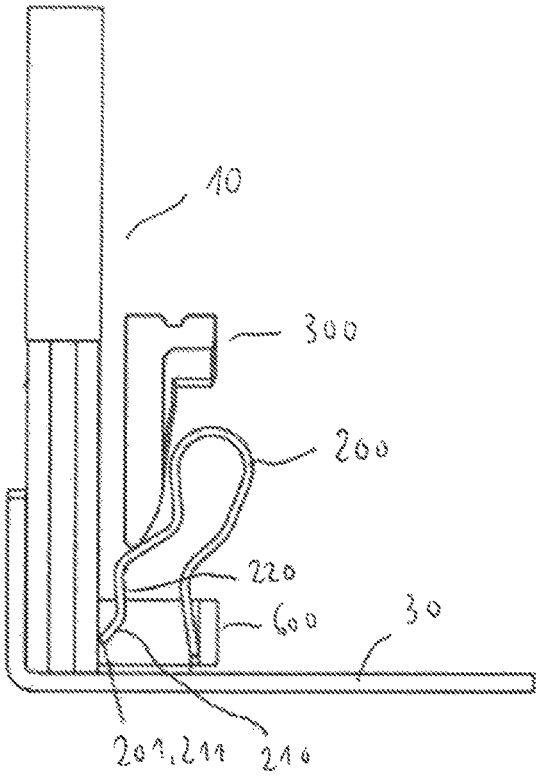
FIG. 3 is a cross section of a contact bridge and a lever for moving the contact bridge of the contacting device, together with an electrical conductor which is pressed against an electrical conducting track by the contact bridge.

FIG. 1 shows an embodiment of a contacting device 1 comprising a housing 100 having a first opening 101 for inserting the electrical conductor 10 and the electrical plug 20 into a cavity 103 in the housing 100 of the contacting device. FIG. 1 shows the electrical plug 20 that is inserted into the cavity 101. The electrical conductor 10 is shown in FIG. 3. The housing 100 comprises a second opening 102 for inserting the electrical conducting track 30 into the cavity 103 in the housing.

The electrical conducting track 30 can, for example, be arranged in a body of an electrical component. Part of the electrical conducting track, which is shown in FIGS. 1, 2A, 2B and 3, can protrude from the body of the electrical component for contacting purposes. The electrical component can, for example, be a motor protection switch, a power protection switch, a motor protection, a power protection or a thermal relay, to name but a few examples. The contacting device 1 can be fastened to the electrical component by means of a fastening element 500, it being possible to arrange the electrical conducting track 30 such that it passes through the opening 102 in the cavity 103 of the contacting device.

According to another embodiment, the electrical conducting track 30 can be designed as an electrically conductive bearing surface of the contacting device. The electrically conductive bearing surface can be electrically coupled to an additional electrical conducting track of an electrical component.

The contacting device 1 further comprises a contact bridge 200 which is arranged in the cavity 103 in the housing 100 of the contacting device. The contact bridge 200 comprises a first portion 210 for fixing the electrical conductor 10 to the electrical conducting track 30 in a force fit. Furthermore, the contact bridge 200 comprises a second portion for retaining the plug 20 on the electrical conducting track 30 and pressing it thereagainst. The second portion 220 of the contact bridge is bent in a different direction from the first portion 210 of the contact bridge. The contacting device 1 also comprises a lever 300 for moving the contact bridge 200 such that the electrical conductor 10 can be released from the force fit. The lever 300 can be moved in a translational manner, for example downwards in the vertical direction, for this purpose, in order to bend the portion 210 of the contact bridge away from the electrical conductor 10. According to another possible embodiment, the lever can be moved such that, during actuation, it pivots or rotates about a center of rotation, in order to bend the portion 210 of the contact bridge away from the electrical conductor 10.

The second portion of the contact bridge 200 is shaped such that the electrical plug 20 can be removed from the cavity 103 in the housing 100 again by pulling on the electrical plug when it is pressed on the electrical conducting track 30 by the contact bridge 200 and is retained in the cavity 103 in the housing 100.

The contact bridge 200 is in particular shaped such that a pulling force that acts on the electrical plug 20 counter to the direction in which said plug is inserted into the first opening 101 in the housing 100 and is required for removing the plug 20 from the housing 100 is smaller than a pulling force that acts on the electrical conductor 10 counter to the direction in which said conductor is inserted into the first opening 101 in the housing 100 and is required for removing the electrical conductor 10 from the housing 100.

Due to the special shape of the contact bridge, it is possible for the electrical conductor 10 to be released from the contacting device again simply by pulling on the electrical conductor, at least not without destroying the function of the contact bridge. In order to release the electrical conductor 10, it is instead necessary to actuate the lever 300 and to press it against the contact bridge 200 such that the contact bridge 200 is further deflected and frees the electrical conductor 10, which can then be removed from the cavity 103 in the housing again.

The contact bridge 200 is fastened to a retaining element 600 in the cavity 103 in the contacting device. Said bridge extends in the cavity 103 from this point to a guide element 700, by means of which said bridge is bent towards a region of the cavity into which the electrical conductor 10 or the electrical conductor 20 is inserted.

According to a possible embodiment of the contacting device 1, the first portion 210 of the contact bridge 200 is formed as a resilient leg which is bent when the electrical conductor 10 is inserted through the first opening 101 into the cavity 103 in the housing 100, and generates a restoring force as a result of the bend. This restoring force causes the contact bridge 200 to press the electrical conductor 10 against the electrical conducting track 30, as shown in FIG. 3.

According to a possible embodiment of the contacting device 1, the first portion 210 of the contact bridge 200 comprises a first end 201 of the contact bridge. The first portion 210 of the contact bridge 200 comprises an edge 211 at the first end 201. The edge 211 is preferably not rounded and is oriented at an acute angle to the electrical conductor 10 when the electrical conductor 10 is inserted through the first opening 101 into the cavity 103 in the housing 100. The edge 211 is in particular shaped such that the pressing force with which the electrical conductor 10 is pressed against the electrical conducting track 30 by the edge 211 is increased when the electrical conductor 10 is pulled counter to the direction in which it is inserted into the first opening 101 in the housing 100.

When the electrical conductor 10 is clamped by the sharp-edged end 201 of the contact bridge following insertion into the cavity 103 in the housing, the sharp-edged end 201 of the contact bridge wedges in the material of the electrical conductor 10. This wedging is further increased when attempts are made to remove the electrical conductor 10 from the contacting device again by pulling it counter to the insertion direction thereof. As a result, it is almost impossible to remove the electrical conductor 10 from the contacting device again simply by pulling on the end of said conductor. In order to release the electrical conductor 10 from the contacting device, the lever 300 must instead be actuated by the lever 300 further deflecting the contact bridge 200.

According to another embodiment of the contacting device, the second portion 220 of the contact bridge 200 comprises a bearing region 221, on which the electrical plug 20 rests when the electrical plug is pressed against the electrical conducting track 30 by means of the contact bridge 200. The surface of the bearing region 221 of the contact bridge, which surface touches the electrical plug 20 when the electrical plug 20 is pressed against the electrical conducting track 30 by means of the contact bridge 20, is greater than the surface of the edge 211 which retains the electrical plug 10 on the electrical conducting track 30 in a force fit.

The contact bridge 200 is in particular shaped such that the second portion 220 of the contact bridge and thus also the bearing region 221 extend in parallel with the direction in which the electrical plug 20 is inserted into the cavity 103 in the housing. The electrical plug 20 therefore merely abuts the bearing portion 221 of the second portion 220 of the contact bridge 200 and is retained by the static friction generated by the pressing force of the deflected contact bridge. By overcoming this frictional force, the plug can be easily released again from the contacting device by pulling it counter to the direction in which it is inserted into the first opening 101. The lever 300 or a correspondingly specially shaped tool does not need to be used for this.

The plug can also be retained on the electrical conducting track 30 by means of a latching snap-in connection in order to prevent the plug pins of the electrical plug slipping out due to shaking or switching pulses.

According to another possible embodiment, the contacting device 1 comprises a stop element 400 which is designed as a stop for the plug 20. As a result, it is possible to insert the plug 20 through the first opening 101 in the housing 100 into the cavity 103 in the housing as far as a depth at which one end of the plug 20 is arranged in the cavity 103 in the housing so as to be at a spacing from the first portion 210 of the contact bridge 200, as shown for example in FIGS. 1, 2A and 2B.

The stop element 400 of the contacting device can be part of the housing. In particular, the stop element 400 can be the part of the housing that is directly adjacent to the first opening 101 in the housing. When the electrical plug 20 is inserted into the opening 101, the electrical plug strikes against the stop element 400 of the contacting device and can therefore not be inserted any further into the cavity 103 in the housing. As a result, the end of the electrical plug 20 does not come into contact with the sharp-edged end 201 of the contact bridge 200.

An arrangement for connecting an electrical cable 2 to an electrical conducting track 30 comprises the contacting device 1 and the electrical plug 20, which is arranged at one end of an electrical cable 2 for contacting the electrical cable. The electrical plug 20 comprises an electrical contact 21 and a non-conductive bearing element 22, on which the electrical contact 21 is arranged.

When the electrical plug 20 is inserted into the first opening 101 in the housing 100 of the contacting device, the bearing region 221 of the second portion 220 of the contact bridge 200 is pressed against the non-conductive bearing element 22 of the electrical plug 20. When the electrical conducting track 30 is inserted into the second opening 102 in the housing 100 of the contacting device, the electrical contact 21 is pressed against the electrical conducting track 30 by the pressing force of the second portion 220 of the contact bridge 200.

According to a possible embodiment, the bearing element 22 of the electrical plug 20 is designed such that the bearing element 22 slides along the bearing region 221 of the portion 220 of the contact bridge 200 when the electrical plug 20 is inserted into the first opening 101 in the contacting device. The electrical plug 20 is therefore retained in the cavity 103 in the housing of the contacting device by the static friction between the bearing element 22 of the plug and the bearing region 221 of the second portion 220 of the contact bridge 200 of the contacting device.

In a similar way to the stop element 400 of the contacting device, the electrical plug 20 can also have a stop element 23 having a corresponding shape. The stop element 23 of the plug 20 and the stop element 400 of the contacting device can be formed relative to one another such that the stop element 23 of the plug 20 strikes against the stop element 400 of the contacting device 1 when the electrical plug 20 is inserted into the first opening 101 in the housing 100 of the contacting device. As a result, the plug 20 can be inserted through the opening 101 in the housing into the cavity 103 in the housing as far as a depth at which the end of the plug 20 is arranged so as to be at a spacing from the first portion 210, in particular the sharp-edged end 201 of the first portion 210, of the contact bridge 200.

Figure 4:
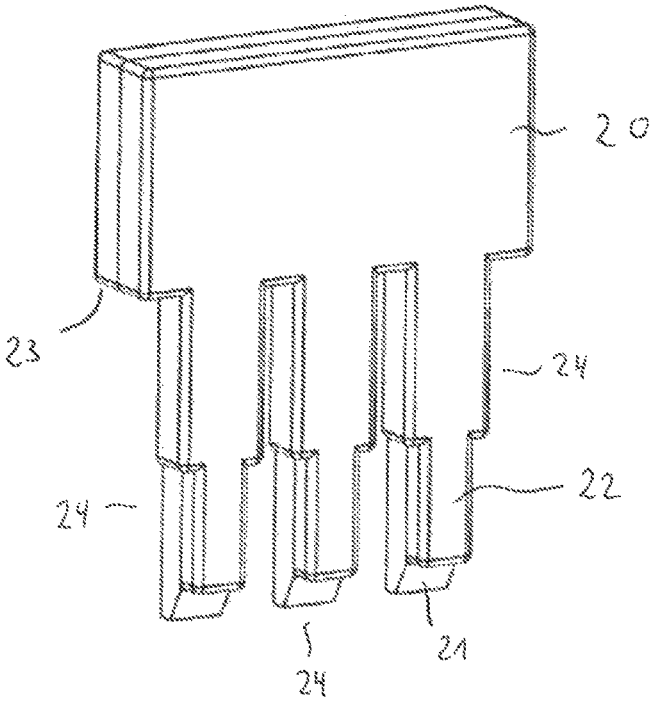
FIG. 4 shows an embodiment of an electrical plug for connection to a cable.

According to the embodiment of the electrical plug shown in FIG. 4, the plug can comprise a plurality of plug pins 24. Each plug pin 24 comprises an electrical contact 21 and a non-conductive bearing element 22, on which the electrical contact 21 is arranged. The contacting device 1 also comprises first openings 101 provided for inserting the pins 24 of the plug, second openings 102 provided for inserting the conducting tracks 30, contact bridges 200 and levers 300, the number of each of which corresponds to the number of plug pins. The contacting device 1 makes it possible, in particular in plugs having a plurality of plug pins, to release the various plug pins from the contacting device simply by pulling the plug out, without it being necessary to actuate an individual lever 300 for each plug pin or to use corresponding tools for each of the plug pins in order to release the contact bridge.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 contacting device
2 cable
10 electrical conductor
20 electrical plug
21 electrical contact of the plug
22 bearing element of the plug
23 stop element of the plug
24 pins of the plug
30 electrical conducting track
100 housing
101 first opening in the housing
102 second opening in the housing
103 cavity
200 contact bridge
201 first end of the contact bridge
210 first portion of the contact bridge
211 edge of the contact bridge
220 second portion of the contact bridge
221 bearing region of the contact bridge
300 lever
400 stop element
500 fastening element
600 retaining element
700 guide element

The invention claimed is:

1. A contacting device for contacting an electrical conductor and an electrical plug with an electrical conducting track, the device comprising:

a housing including a first opening configured for insertion of the electrical conductor and the electrical plug into a cavity in the housing, and including a second opening configured for insertion of the electrical conducting track into the cavity in the housing;

a contact bridge, arranged in the cavity in the housing, including a first portion configured to fix the electrical conductor to the electrical conducting track in a force fit, and a second portion configured to retain the electrical plug on the electrical conducting track and press the electrical plug against the electrical conducting track, the second portion being bent in a different direction from the first portion; and a lever configured to move the contact bridge such that the electrical conductor can be released from the force fit, wherein the second portion of the contact bridge is shaped such that the electrical plug can be removed from the cavity in the housing by pulling on the electrical plug when the electrical plug is pressed on the electrical conducting track by the contact bridge and is retained in the cavity in the housing.

2. The device of claim 1, wherein the contact bridge is shaped such that a pulling force that acts on the electrical plug counter to a direction in which the electrical plug is inserted into the first opening in the housing, and is required for removing the electrical plug from the housing, is smaller than a pulling force that acts on the electrical conductor counter to the direction in which said conductor is inserted into the first opening in the housing and is required for removing the electrical conductor from the housing.

3. The device of claim 1, wherein the first portion of the contact bridge is formed as a resilient leg which is bent, forming a bend, when the electrical conductor is inserted through the first opening into the cavity in the housing, and wherein the bend generates a restoring force, the leg pressing the electrical conductor against the electrical conducting track using the restoring force.

4. The device of claim 2, wherein the first portion of the contact bridge includes a first end of the contact bridge, wherein the first portion of the contact bridge includes an edge at the first end of the contact bridge, wherein the edge is shaped such that a pressing force with which the electrical conductor is pressed against the electrical conducting track by the edge at the first end of the contact bridge is increased when the electrical conductor is pulled counter to the direction in which it is inserted into the first opening in the housing.

5. The device of claim 2, wherein the second portion of the contact bridge includes a bearing region, on which the electrical plug rests when the electrical plug is pressed against the electrical conducting track using the contact bridge, wherein a surface of the bearing region that touches the electrical plug when the electrical plug is pressed against the electrical conducting track using the contact bridge is greater than a surface of the edge which retains the electrical conductor on the electrical conducting track in a force fit.

6. The device of claim 5, wherein the contact bridge is shaped such that the bearing region of the second portion of the contact bridge extends in parallel with the insertion direction of the electrical plug.

7. The device of claim 2, further comprising:

a stop element, designed as a stop for the electrical plug and as a result of which the electrical plug can be inserted through the first opening in the housing into the cavity in the housing as far as a depth at which one end of the electrical plug is arranged in the cavity in the housing so as to be at a spacing from the first portion of the contact bridge.

8. An arrangement for connecting an electrical cable to an electrical conducting track, comprising:

the device of claim 1, the electrical plug, arranged at one end of the electrical cable, configured to contact the electrical cable, wherein the electrical plug includes an electrical contact and a non-conductive bearing element, on which the electrical contact is arranged, wherein the bearing region of the second portion of the contact bridge is pressed against the non-conductive bearing element of the electrical plug when the electrical plug is inserted into the first opening in the housing of the contacting device, wherein the electrical contact of the electrical plug is pressed against the electrical conducting track by a pressing force of the second portion of the contact bridge when the electrical conducting track is inserted into the second opening in the housing of the contacting device.

9. The arrangement of claim 8, wherein the non-conductive bearing element of the electrical plug is designed such that the bearing element slides along the bearing region of the second portion of the contract bridge when the electrical plug is inserted into the first opening in the contacting device, and wherein the electrical plug is retained in the cavity in the housing of the contacting device by static friction between the bearing element of the electrical plug and the bearing region of the second portion of the contact bridge of the contacting device.

10. The arrangement of claim 8, wherein the electrical plug includes a stop element, wherein the stop element of the electrical plug and a stop element of the contacting device are formed relative to one another such that the stop element of the electrical plug strikes against the stop element of the contacting device, as a result of which the electrical plug can be inserted through the first opening in the housing into the cavity in the housing as far as a depth at which the end of the electrical plug is arranged so as to be at a spacing from the first portion of the contact bridge.

* * * * *